US005083960A

United States Patent [19]

Erickson

[11] Patent Number: 5,083,960

[45] Date of Patent: Jan. 28, 1992

[54] DOMINO EFFECT TOY WITH RETURN CASCADE

[76] Inventor: Kent E. Erickson, 52 Locksley Rd., Glen Mills, Pa. 19342

[21] Appl. No.: 664,124

[22] Filed: Mar. 4, 1991

[51] Int. Cl.[5] ..... A63H 33/04; A63H 33/00; A63F 1/00

[52] U.S. Cl. ..... 446/2; 446/487; 273/292

[58] Field of Search ..... 446/2, 3, 487; 273/292, 273/293, 294, 295

[56] References Cited

U.S. PATENT DOCUMENTS

| | | | |
|---|---|---|---|
| 2,713,489 | 7/1955 | Glaser | 446/2 X |
| 3,621,601 | 1/1969 | Greenberg et al. | 446/2 |
| 4,248,433 | 2/1981 | Soriano | 446/2 X |
| 4,632,664 | 12/1986 | Manning | 446/2 |

FOREIGN PATENT DOCUMENTS

| | | | |
|---|---|---|---|
| 548858 | 4/1932 | Fed. Rep. of Germany | 446/2 |

*Primary Examiner*—David N. Muir

[57] ABSTRACT

A children's toy employing the domino effect in which the cascadable elements are hinged to linkable sections of track in such a manner that upon completion of the forward cascade a further cascade ripples through the same cascadable elements in the reverse direction.

6 Claims, 2 Drawing Sheets

DOMINO EFFECT TOY WITH RETURN CASCADE

BACKGROUND OF THE INVENTION

1. Field of the Invention

The invention relates generally to children's toys and more specifically to children's toys which employ domino effect cascades.

2. Description of the Prior Art

Generations of children have entertained themselves by setting up sequences of dominoes or other cascadable elements, then toppling the first cascadable element and watching the remaining cascadable elements fall in a sequential cascade. There have been certain deficiencies in this procedure: (a) the cascadable elements often become scattered or lost; (b) many children do not have the temperment or the motor skills needed to successfully position individual elements in a cascadable sequence. To overcome these deficiencies, short sequences of cascadable elements have been hinged to bases, hereinafter termed "sections of track", which can be concatenated into longer cascadable sequences. These cascadable sequences, however, have been limited to cascades which do not ripple in the reverse direction upon completion of the forward cascade. The present invention provides a cascade in the reverse direction which allows children the pleasure of initiating a cascade and having it return to them.

SUMMARY OF THE INVENTION

The invention is a toy in which cascadable elements are hinged to sections of track and the sections of track are linkable to one another in such a manner as to sustain a domino effect cascade. The spacing between successive cascadable elements is so arranged that the forward end of each element in a cascade comes to rest supported by the rear end of the succeeding element in the cascade except in the case wherein the succeeding element is unsupported by a successor. The last element in the cascade is unsupported by a successor. This leads to loss of support for the next-to-last element which in turn leads to loss of support for the next previous element, etc. The result is a cascade which ripples through the cascadable elements in the reverse direction from the forward cascade.

In a preferred embodiment, the cascadable elements and the linkage between sections of track are so designed as to permit substantial variability in the angle of linkage between successive sections of track without impairing either the forward cascade or the reverse cascade.

It is an object of this invention to provide children with the pleasure of having a domino effect cascade which they initiated return to them. It is a further object of this invention to provide children with the pleasure of having a domino effect cascade which they initiated return to them after it has meandered along a course which they themselves have established.

DESCRIPTION OF THE PREFERRED EMBODIMENT

Referring to FIGS. 1 through 10, an embodiment of the invention is shown. In this embodiment cascadable elements 1 are hinged to sections of track 2 by hinges 3. The number of cascadable elements 1 in each section of track 2 is arbitrary and may vary from one section of track to another.

Figure 5:
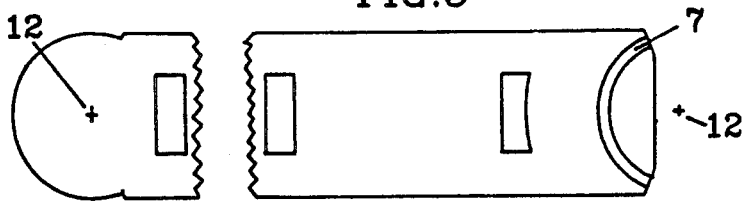
FIG. 5 is a top view of a section of track.
Figure 6:
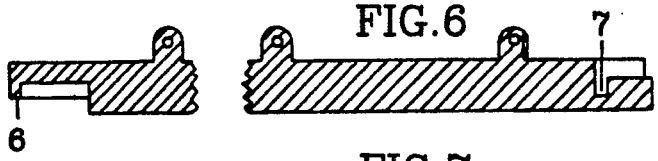
FIG. 6 is a sectional view of a section of track in the plane of symmetry.
Figure 7:
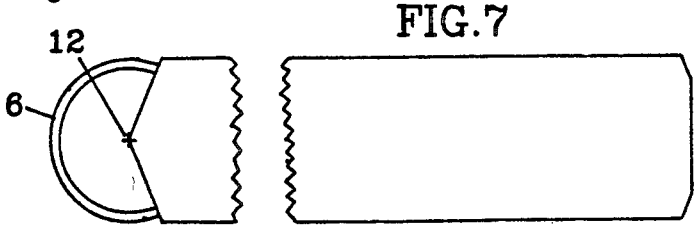
FIG. 7 is a bottom view of a section of track.

Referring to FIGS. 5,6,7, it is clear that sections of track 2 are linkable by engaging arcuate ridge 6 on the bottom of one section of track 2 with arcuate groove 7 on the top side of another section of track 2. The fact that the are length of arcuate groove 7 is shorter than the are length of arcuate ridge 6 allows arcuate groove 7 to slide along arcuate ridge 6 about linkage axis 12 so as to provide variability in the angle of linkage. As noted below, considerable freedom exists in the design of suitable linkage.

Figure 2:
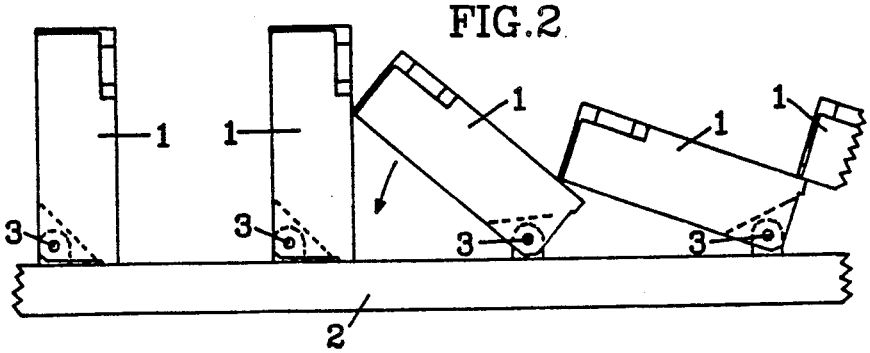
FIG. 2 is a side view of a forward cascade in progress.
Figure 3:
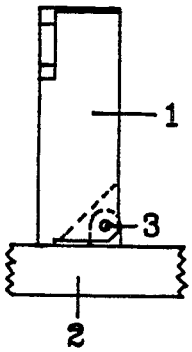
FIG. 3 is a side view of a cascadable element hinged to a section of track.
Figure 4:
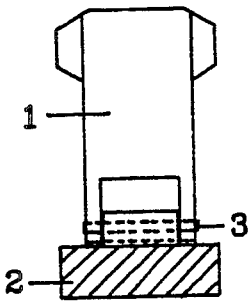
FIG. 4 is a front view of a cascadable element hinged to a section of track.

Referring to FIG. 2, it is clear that cascadable elements 1, if originally disposed in an upright position, can propagate a forward cascade through all cascadable elements on a given section of track 2.

Figure 8:
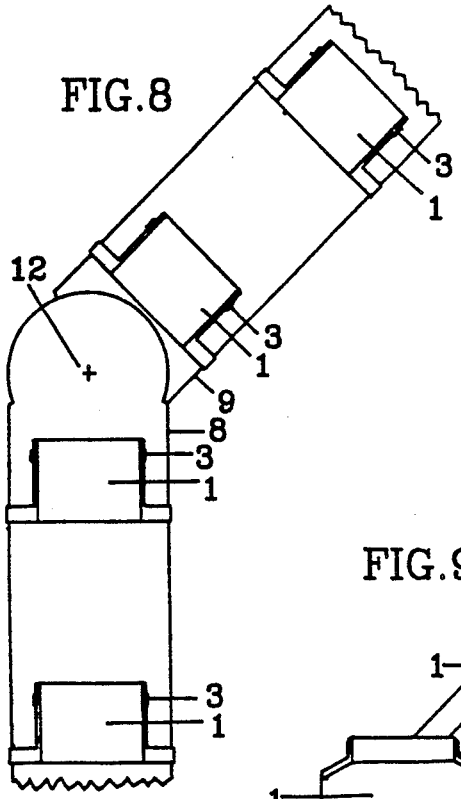
FIG. 8 is a top view of cascadable elements prior to a forward cascade showing a region in which a change of direction occurs between ajacent sections of track.
Figure 9:
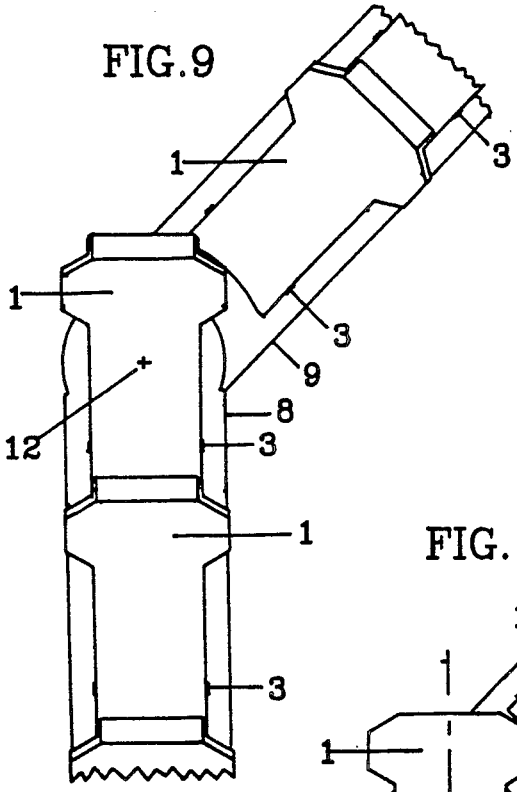
FIG. 9 is a top view of the cascadable elements shown in FIG. 8 after a forward cascade has occurred but before a reverse cascade has occurred.

Referring to FIG. 8 in conjunction with FIG. 9, it is clear that a forward cascade can propagate from one section of track 8 to an ajacent section of track 9 despite significant variability in the angle of linkage between said sections of track about linkage axis 12.

Figure 1:
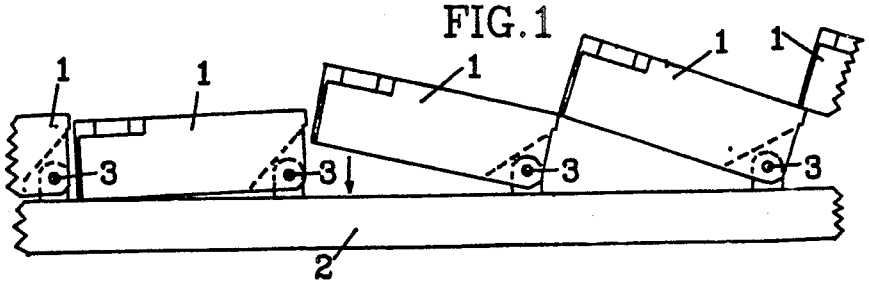
FIG. 1 is a side view of a reverse cascade in progress showing some cascadable elements still supported by their successors and other cascadable elements unsupported by their successors.

Referring to FIG. 1, it is clear that cascadable elements 1 as disposed by a forward cascade can propagate a reverse cascade through all cascadable elements 1 on a given section of track 2.

Figure 10:
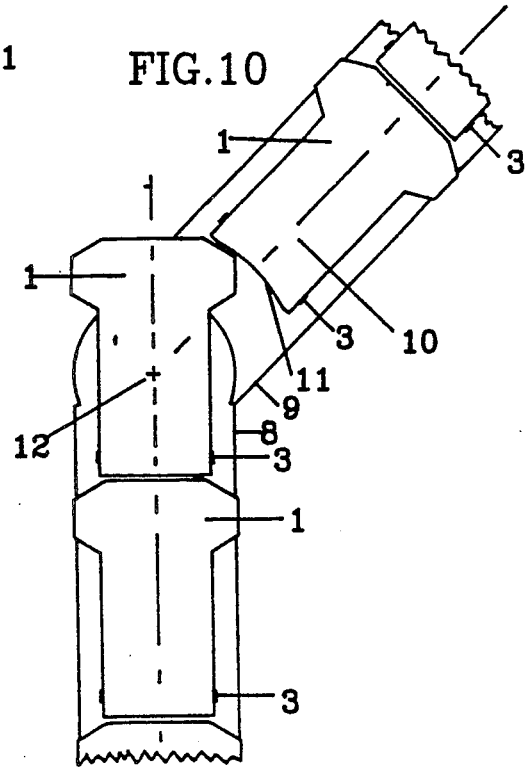
FIG. 10 is a top view of the cascadable elements shown in FIG. 9 after a reverse cascade has occurred.

Referring to FIG. 9 in conjunction with FIG. 10, it is clear that a reverse cascade can propagate from one section of track 9 to an adjacent section of track 8 despite significant variability in the angle of linkage between said sections of track about linkage axis 12.

Referring to FIGS. 9 and 10, it is clear that considerable freedom exists in the design of the linkage between ajacent sections of track. The essential feature is that the first cascadable element 10 in the forward section of track 9 have its trailing edge contoured in an are 11 such that, when said cascadable element 10 is in a prone position as shown in FIG. 10, are 11 is approximately centered on linkage axis 12.

It will be clear to those skilled in mechanical design that considerable deviation is possible from the particular design shown herein while still preserving the cascadability essential to this invention.

I claim:

1. A domino toy assortment comprising a plurality of racks, each of said racks mounting a plurality of dominoes, each of said dominoes having a set thickness and being hingedly connected to a rack, each of said dominoes having a set length and being connected to said rack at a set interval, said interval being dependent upon said domino length and thickness so that when said dominoes are cascaded from first to endmost, each cascaded domino will rest upon a corner of a subsequent domino, and when said endmost domino is fallen to lie flat, the corner supporting a preceding domino will be moved from engagement causing said preceding domino to fall further to a flat position thereby causing each preceding domino to sequentially fall to a flat position resulting in a second reverse cascade.

2. A domino mounting rack of claim 1 wherein ends of the rack have connectors, wherein the connectors are one of an arc member or a groove member, so that one rack arc member is receivable by a subsequent rack groove member allowing said racks to be placed at a variable angle between said racks.

3. A domino toy of claim 1 wherein at least one of the plurality of dominoes is non-rectangular.

4. A domino toy of claim 3 wherein at least one of the plurality of dominoes has a flare on an upper portion of said domino.

5. A domino toy of claim 1 wherein each of said racks contains pivot means allowing an attachment between racks at a wide variety of angles.

6. A domino toy of claim 1 wherein said endmost domino initiates an additional cascade of objects not mounted on one of said racks.

* * * * *